United States Patent [19]

Stockman

[11] 4,073,337

[45] Feb. 14, 1978

[54] ROTARY REGENERATOR PIN RACK SEAL

[75] Inventor: Richard Franklin Stockman, Friendship, N.Y.

[73] Assignee: The Air Preheater Company, Inc., Wellsville, N.Y.

[21] Appl. No.: 704,220

[22] Filed: July 12, 1976

[51] Int. Cl.[2] ..... F28D 19/00

[52] U.S. Cl. ..... 165/9

[58] Field of Search ..... 165/8, 9

[56] References Cited

U.S. PATENT DOCUMENTS 2,670,934 3/1954 Hammond et al. ..... 165/9

3,011,766 12/1961 Hess ..... 165/9

*Primary Examiner*—Albert W. Davis, Jr.

*Attorney, Agent, or Firm*—Wayne H. Lang

[57] ABSTRACT

An air preheater comprising a housing that encloses a cylindrical rotor carrying a mass of heat absorbent material alternately between a passageway carrying a stream of hot gas and a passageway carrying a stream of cooler air. Special axially disposed sealing means are disposed in the annular space between the rotor and the rotor housing to preclude fluid by-passing the heat absorbent material of the rotor.

5 Claims, 5 Drawing Figures

ROTARY REGENERATOR PIN RACK SEAL

BACKGROUND OF THE INVENTION

1. Field of the Invention

This invention relates to rotary regenerative heat exchange apparatus in which a mass of heat absorbent material commonly comprised of packed element plates is positioned in a passageway for hot gas to absorb heat from the hot gases passing therethrough. After the plates become heated by the hot gas they are moved to a cool air passageway where the heated plates transmit their heat to the cooler air. The heat absorbent material is commonly carried in open-ended baskets which are in turn carried in the rotatable rotor. To prevent mixing of the gas and air, opposite end edges of the rotor are provided with apertured sector plates that direct independent streams of gas and air through the rotor while axial sealing plates lying in the annular space between the rotor and the rotor housing preclude circumferential flow of fluid around the rotor.

The rotor is turned about its axis by an annular driving gear that extends around the rotor and is driven by a suitable prime mover. The annular driving gear presents an irregular surface that defines a multiplicity of flow passages through which high pressure fluid may flow to a low pressure zone. As the high pressure fluid with particulate matter entrained therein moves past the irregular surface, a high velocity jet stream is produced with a sandblasting effect that rapidly abrades the adjacent parts of the rotor and the rotor housing, thus producing lowered efficiency and rapid abrasion of the adjacent parts of the rotor.

SUMMARY OF THE INVENTION

In accordance with this invention, I propose to preclude the harmful effects of high pressure air flowing past the irregular surface of a driving gear of an air preheater by providing a unique sealing means that conforms to the irregular surface of the driving gear to prevent leakage thereby.

The sealing means comprises multiple-labyrinth-type leaves arranged normal to the driving gear to permit only limited flow therebetween. However, the velocity of the fluid flowing by the sealing means is inherently reduced to a degree that makes it impossible for the particulate matter entrained therein to have a "sandblasting" or other detrimental effect upon the adjacent metal surfaces, or the loss of fluid to itself significantly lower the operating efficiency of the heat exchanger.

BRIEF DESCRIPTION OF THE DRAWING

Further details of the invention are hereinafter described with reference to the figures of the accompanying drawings in which.

DESCRIPTION OF THE PREFERRED EMBODIMENT

Figure 1:
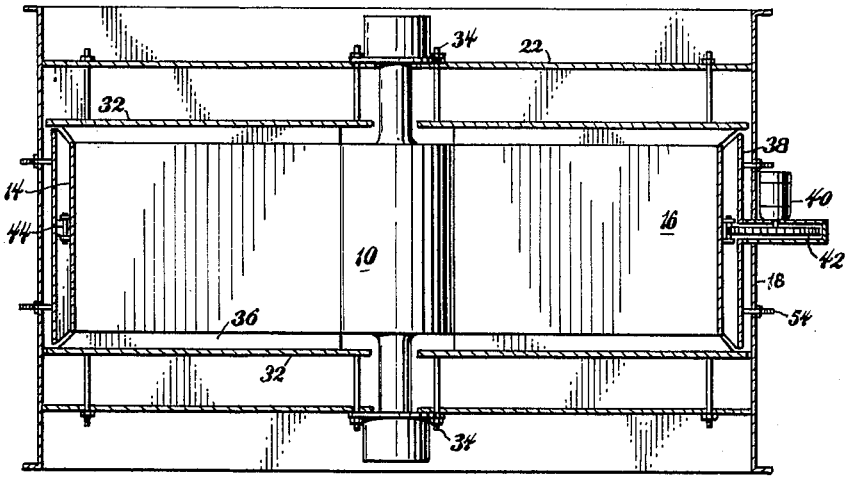
FIG. 1 is a sectional side elevation of a rotary regenerative heat exchanger involving the present invention.
Figure 2:
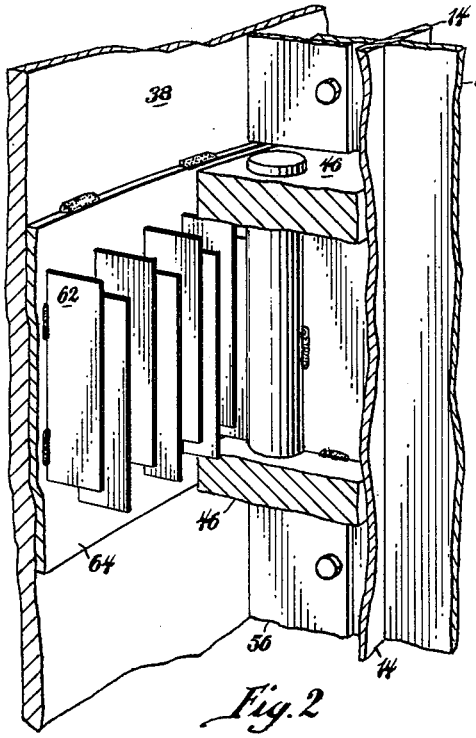
FIG. 2 is an enlarged section of the seal with portions broken away.

The arrangement of the drawing shows a rotary regenerative heat exchanger having a central rotor post

10 connected by diaphragms 12 to a cylindrical rotor shell 14. The rotor contains a mass of heat absorbent plates 16, all of which are contained in a rotor housing 18 having end plates 22 at opposite ends thereof with suitable apertures for the inlet and outlet of a heating fluid and a fluid to be heated.

Sector plates 32 are provided intermediate ends of the rotor and the end plates to further limit the heating fluid and the fluid to be heated to their respective passageways. The inboard ends of the sector plates are supported by hangers 34 adjacent the ends of the radial seals 36, while the outboard ends of the sector plates are supported by hangers 34 adjacent ends of the axial sealing plates 38.

The rotor is turned about its axis within the rotor housing by a suitable motor 40 driving a drive gear 42 that intermeshes with a pin rack extending completely around the rotor. The pin rack comprises a pair of flanges 46 affixed to the rotor and having a series of spaced pins 48 that extend axially therebetween.

Axial sealing plates 38 are supported on the housing by adjustable pins 54 so that they extend axially between sector seals 32 to preclude fluid flow circumferentially past the rotor. The peripheral edges of the rotor are provided with flexible sealing leaves 56 attached to ribs 58 that extend axially and rub against the innter surface of the axial seal 38 to preclude the flow of fluid. However, the space outward from the pin rack 46–48 comprises a leakage path through which fluid may flow. Any attempt to block this flow of fluid has created a restriction through which fluid would flow with increased velocity. Therefore, any particulate material entrained in the high velocity fluid flowing past the pins 48 of the driving gear would produce a "sandblasting effect" that would quickly abrade the driving gear, the sealing means, and the adjacent parts of the rotor.

This invention is, therefore, directed to a particular sealing arrangement that is positioned between the axial sealing plate 38 and the annular pin rack 46–48 to preclude the flow of fluid thereby, or at least reduce its velocity of flow to such a degree that entrained particulate matter will not abrade the adjacent parts of the rotor and the rotor housing.

Accordingly, series of axially disposed baffle members 62 are secured along a longitudinal edge thereof to a plate member 64 that is in turn secured as by welding to the inner surface of opposite axial seal plates 38. The baffle members 62 are positioned in an axially parallel relationship intermediate the pin rack flanges 46, and they extend radially to substantially fill the space between the axial seal plate 38 and the pins 48 whereby they comprise successive barriers that lower the pressure of fluid flowing thereby.

The individual baffle members 62 are comprised of a light gauge deformable material and they are preferably installed in a staggered relationship whereby they may readily conform to longitudinal shifting of the rotor and the rotor housing and still provide the necessary baffletype sealing.

The space lying between each pin 48 and the rotor shell 14 is occupied by a filler plate 66 whose function is to provide a positive barrier to the flow of fluid, thus closing off the entire space adjacent the pin rack drive 46–48 to the flow of fluid thereby. While some fluid may make its way past the baffles 62, its velocity of flow will be slowed so that particulate matter entrained therein will not have an abrasive effect upon the adjacent parts of the rotor and the rotor housing.

Figure 3:
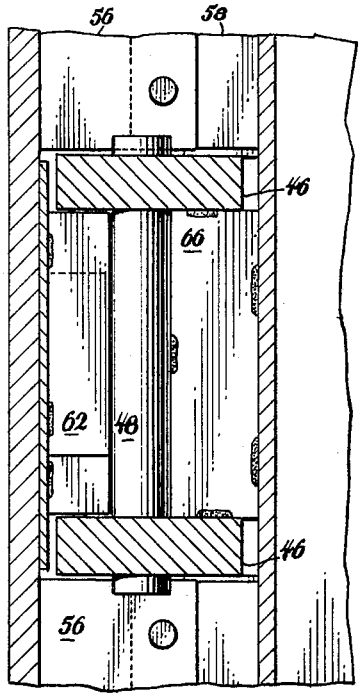
FIG. 3 is a side section of the seal.
Figure 4:
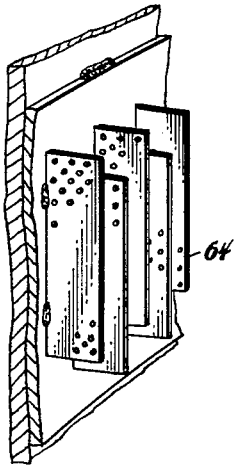
FIG. 4 is a first modification of the seal of FIG. 2.
Figure 5:
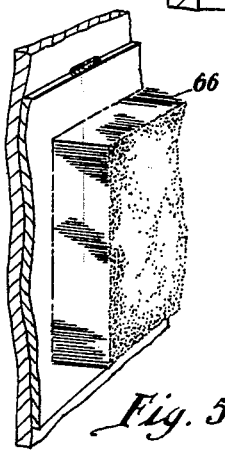
FIG. 5 is a second modification of the seal of FIG. 2.

While the invention has been described with reference to the embodiment shown in FIG. 3 of the drawing where members 62 are made from imperforate plates, they could easily be formed from thin perforate sheet similar to that shown by plates 64 in FIG. 4 to produce a more easily deformable baffle between the rotor and the rotor housing. Similarly, the flexible sealing members could well be formed from flexible brush-like members 66 to produce a universally flexible sealing means.

It is, thus, apparent that various changes may be made without departing from the spirit of the invention. It is, therefore, intended that all material contained in the above description or shown in the accompanying drawings shall be interpreted as illustrative and not in a limiting sense.

I claim:

1. A regenerative heat exchange apparatus having a central rotor post, a concentric rotor including a mass of heat absorbent material carried by the rotor post, housing means surrounding the rotor having inlet and outlet ports at opposite ends thereof for a low pressure heating fluid and a high pressure fluid to be heated, bearing means supporting the rotor within the housing for rotation about its axis, sector plates adjacent ends of the rotor lying between ports in the housing to separate the several fluids, axial sealing plates extending axially through the space between the rotor and the rotor housing between ends of the sector plates, an annular drive rack extending circumferentially around the rotor, means engaging the annular drive rack to rotate the rotor about its axis, and baffle means intermediate the axial sealing plates and the annular drive rack adapted to preclude fluid flow therebetween, said baffle means comprising a series of axially disposed plate members carried by the axial sealing means to confront the annular drive rack and restrain fluid flow past the irregular surface of the drive rack that would have a sandblasting effect upon the adjacent parts of the rotor and the rotor housing.

2. A regenerative heat exchange apparatus having a central rotor post and a concentric mass of heat absorbent material as defined in claim 1 wherein the baffle members comprise resilient plate members lying substantially normal to the annular drive rack that extends around the rotor.

3. A regenerative heat exchange apparatus having a central rotor post and a concentric mass of heat absorbent material as defined in claim 2 wherein the resilient plate members are spaced apart to provide a succession of adjacent plenum chambers therebetween.

4. A regenerative heat exchange apparatus having a central rotor post and a concentric mass of heat absorbent element as defined in claim 1 wherein the resilient baffle comprises a series of axially spaced perforate plates.

5. A regenerative heat exchange apparatus having a central rotor post, a concentric rotor including a mass of heat absorbent material carried by the rotor post, housing means surrounding the rotor having inlet and outlet ports at opposite ends thereof for a low pressure heating fluid and a high pressure fluid to be heated, bearing means supporting the rotor within the housing for rotation about its axis, sector plates adjacent ends of the rotor lying between ports in the housing to separate the several fluids, axial sealing plates extending axially through the space between the rotor and the rotor housing between ends of the sector plates, an annular drive rack extending circumferentially around the rotor, means engaging the annular drive rack to rotate the rotor about its axis, and baffle means intermediate the axial sealing plates and the annular drive rack adapted to preclude fluid flow therebetween, said baffle means comprising the bristles of a brush-like device carried by the axial sealing means to confront the annular drive rack and restrain fluid flow past the irregular surface of the drive rack that would have a sandblasting effect upon the adjacent parts of the rotor and the rotor housing.

* * * * *